US007877952B2

(12) United States Patent
Milani

(10) Patent No.: US 7,877,952 B2
(45) Date of Patent: Feb. 1, 2011

(54) PROCESS FOR MAKING WATER RECEPTACLES IN GENERAL

(76) Inventor: Alessandro Milani, Via dei Colli 4a, Montegrotto Terme (PD) (IT) 35036

( * ) Notice: Subject to any disclaimer, the term of this patent is extended or adjusted under 35 U.S.C. 154(b) by 239 days.

(21) Appl. No.: 12/065,913

(22) PCT Filed: Sep. 5, 2006

(86) PCT No.: PCT/IT2006/000641

§ 371 (c)(1),
(2), (4) Date: Apr. 12, 2008

(87) PCT Pub. No.: WO2007/029277

PCT Pub. Date: Mar. 15, 2007

(65) Prior Publication Data

US 2008/0245465 A1 Oct. 9, 2008

(30) Foreign Application Priority Data

Sep. 9, 2005 (IT) ..... PD2005A0261

(51) Int. Cl.

| | |
|---|---|
| ***E02D 17/04*** | (2006.01) |
| ***E02D 17/10*** | (2006.01) |
| ***E02D 17/13*** | (2006.01) |
| ***E02D 17/20*** | (2006.01) |
| ***E04B 1/00*** | (2006.01) |

(52) U.S. Cl. ..... 52/741.12; 52/169.5; 52/169.4; 52/169.14; 52/745.19; 52/169.7; 405/302.4; 405/302.7

(58) Field of Classification Search ..... 405/19, 405/28, 38, 40, 128, 129, 270, 258, 15, 32, 405/50, 128.1, 129.1, 229, 282, 284, 302.7, 405/302.4; 52/169.1, 169.2, 169.3, 169.5, 52/169.6, 169.7, 169.14, 741.11, 741.12, 52/742.1, 742.12, 742.16

See application file for complete search history.

(56) References Cited

U.S. PATENT DOCUMENTS 3,252,251 A * 5/1966 Simmous ..... 47/29.1

(Continued)

FOREIGN PATENT DOCUMENTS

GB 2356343 5/2001

(Continued)

*Primary Examiner*—Jeanette Chapman
(74) *Attorney, Agent, or Firm*—Themis Law

(57) ABSTRACT

A process for constructing water receptacles such as swimming pools, fountains and artificial ponds, comprising in one embodiments the following steps: excavating the receptacle; preparing the foundation by laying a layer of sand on the bottom of the excavation; laying of one or more sheets of a non-woven fabric on the internal surface of the excavation and on the foundation layer; laying a waterproofing layer on top of said sheet of non-woven fabric; disposing modular elements for stabilizing the lining to be applied; adding all equipment necessary for a proper functioning of said basin, swimming pool, etc.; lining the internal walls of the receptacle and/or of the bottom of the receptacle and/or of the edge of the receptacle with smoothed natural stones disposed on top of said waterproofing layer; and applying a binding resin on said lining.

10 Claims, 2 Drawing Sheets

U.S. PATENT DOCUMENTS 5,056,960 A * 10/1991 Marienfeld ..... 405/270
5,090,154 A * 2/1992 Jacob ..... 47/9
5,258,217 A * 11/1993 Lewis ..... 428/120
5,288,168 A * 2/1994 Spencer ..... 405/54
5,544,976 A * 8/1996 Marchbanks ..... 405/129.6
6,386,796 B1 * 5/2002 Hull ..... 405/128.25
2003/0077389 A1 4/2003 Jones
2007/0199341 A1 * 8/2007 Hart ..... 62/260

FOREIGN PATENT DOCUMENTS

NL 7000289 7/1970

* cited by examiner

PROCESS FOR MAKING WATER RECEPTACLES IN GENERAL

FIELD OF THE INVENTION

The present invention concerns swimming pools, fountains, basins, etc., and, in particular, concerns a process for constructing swimming pools, fountains and artificial ponds in general, also for bathing, making use of natural elements.

BACKGROUND OF THE INVENTION

Basins, fountains and artificial ponds in general for ornamental use are known.

Items of this type are made with a lining made of stones, partly sunk in concrete or simply placed together and stacked dry, that is, without any binder.

Said basins may also be used for raising aquatic species, such as plants or fish.

In this case, said basins are also provided with equipment such as filters, pumps and other accessories required for cleaning, oxygenating and recirculating the water and for all the operations necessary for the survival of the guest species.

Swimming pools for bathing are also known, both sunk into the ground and not, the construction of which is extremely complex and expensive.

Above all, the terrain must be excavated and subsequent operations carried out to level the bottom and retain the walls.

The side walls and the bottom of the swimming pool are usually made of reinforced concrete, which is treated with water-resistant products and lined with ceramic elements.

Walls are also known that are made of steel panels, the surface of which is suitably treated with resins and paints, on the exposed part, and with waterproofing products on the internal surface in contact with the ground.

The known swimming pools typically have a regular shape, with a horizontal or gradually sloping bottom and vertical side walls.

To complete the swimming pool, filters are also installed, inlets and outlets, overflows, collection channels, pumps and all the other equipment necessary for the correct function and use of the swimming pool.

In particular, for known swimming pools for bathing, it is fundamental to install special equipment for filtering and sanitizing the water, for removing and eliminating impurities and pathogenic factors which could cause possible infections.

However, the known receptacles made of reinforced concrete and lined with tiles need frequent and expensive maintenance and repair work.

Cracks often appear on the surface of the tiles, due mainly to the uneven settling of the bottom with consequent likelihood of the tiles becoming detached, while the waterproofing paint covering must be touched up frequently.

Unlike the basins and artificial ponds described previously, sunken swimming pools in reinforced concrete have a great impact on the environment, being aesthetically a non natural element and therefore difficult to insert.

SUMMARY OF THE INVENTION

To overcome the above drawbacks, a new type of process has been developed for making swimming pools, basins, fountains and artificial ponds in general.

The main aim of the present invention is to construct a swimming pool, basin, fountain, etc., even for bathing, of any shape and size, using natural materials.

Another important aim of the present invention is to construct items that are aesthetically pleasing and that can be perfectly integrated in any context or environment, even a natural one, even using a new flat base element.

Another aim of the present invention is to reduce and facilitate maintenance and cleaning operations.

Another aim of the present invention is to reduce maintenance and running costs.

These and other aims, direct and complementary, are achieved by the new process for producing swimming pools, basins, fountains and artificial ponds in general, using natural elements.

The process consists substantially of a first excavation phase, carried out using known techniques, with the shapes required by the aesthetic requirements.

The next phase contemplates the preparation of the foundation, by laying a layer of sand, clay or other suitable material to level the bottom and prevent the presence of elements which could damage the layers above.

After making the foundation layer, one or more sheets of non-woven fabric are laid on the entire internal surface of the excavation, on top of which the waterproofing layer is then applied.

Said waterproofing layer is constructed with sheets of a waterproof polymer material such as PVC or another material with similar properties and performance.

The subsequent phases consist of operations to line the walls and the bottom of the receptacle and of applying the necessary and adequate equipment for its correct functioning, such as inlets and outlets, filters, etc.

For the construction of the lining of the internal walls and of the bottom of the receptacle, the new process contemplates the use of tiles or preferably of elements of natural material, such as river stones, pebbles and rocks of various dimensions.

Said stones preferably have a rounded and smoothed shape, that, is without sharp corners, for obvious reasons of safety, comfort and appearance.

For this purpose it is preferable to use river stones and pebbles, already naturally rounded and smoothed by the erosive action of water.

The process preferably comprises the positioning of a surface made up of flat modular elements, preferably deformable to suit the progress of the walls and of the bottom of the swimming pool. These flat modular elements are provided with folding lines and with supporting elements or pegs and a block of coating pebbles or stones.

Then, said stones are positioned on or inside said flat modular elements placed on top of said waterproofing layers, and a special resin is applied, before and after laying the stones, to fix the stones firmly in the desired position.

Said stones are distributed in such a way as to cover the entire internal surface of the receptacle.

Said binding resin is homogeneously distributed both in the interstitial spaces in the layer of covering stones, that is between one stone and another, and on the free surface of said stones.

With this process all the stones are covered completely, so that the covering obtained is stable and totally waterproof.

In one embodiment of the invention, these stones or pebbles of various sizes are mixed in a mixer along with the resin, still in a fluid state, so that all the surfaces of each pebble or stone are wet with said resin. This mixture of said pebbles and/or stones treated with resin is spread on said waterproof layer or on said flat modular elements.

Alternatively, said binding resin may be distributed only in the interstitial spaces in the covering layer, so as to bind said stones effectively, but leaving their free upper surface uncovered.

For the construction of profiles or counter-profiles with a particular shape, with reduced corners or bending radii, the present invention contemplates the use of polystyrene profiles on which said waterproofing layer and said covering stones are applied.

Thanks to said counter-profiles, it is therefore possible to construct with greater ease every type of profile of the walls and of the bottom of the receptacle.

The use of smoothed natural stone for lining the receptacle provides numerous advantages.

First of all, the use of this type of material allows excellent results to be obtained even in lining receptacles with an extremely irregular shape, where, on the contrary, the use of the known tiles would require an accurate and complex work of shaping the tiles.

The extreme variety in the shape and dimensions of the stones used provides extremely original results.

The use of natural materials, without the need to use iron, concrete, etc., facilitates even the visual integration of the manufactured item in the surrounding natural environment.

Moreover, natural stone has a high aesthetic value, making this material suitable also for the construction of ornamental fountains or artificial ponds.

Unlike other materials commonly used, natural stones accumulate heat and help raise the water temperature.

The lining of smoothed natural stones is therefore extremely comfortable for bathers and allows the creation of a natural environment that does not require draining and covering in winter.

Accordingly, the running, maintenance and water heating expenses are considerably reduced.

Said stones may also be used to cover the edge of the receptacle, where the overflows are usually located, as well as the perimeter channels and the equipment for collecting, filtering and recirculating the water.

Said stones are suitably laid above said overflows and said perimeter channels and the binding resin is distributed in such a way as not to saturate the interstitial spaces between the stones, thus leaving channels for the draining water to pass through.

The stones therefore create a waterproof draining layer through which the water leaves the receptacle and is collected beyond the overflows, in the perimeter channels.

Said overflows and said channels are therefore concealed from view and the aesthetic value of the manufactured item is considerably improved.

Alternatively, the present invention contemplates the use of artificial stones, reproducing natural and non natural elements, such as stone slabs, steps, etc.

A process is also disclosed for the construction of basins, swimming pools, fountains and artificial ponds in general, that includes the optional laying on the bottom of the excavation of at least one layer of sand, clay or other suitable material; laying one or more sheets of non-woven fabric on the internal surface of the excavation and on the foundation layer; applying a waterproofing layer on top of said sheet of non-woven fabric; installing filters, ducts, inlets and outlets, collecting channels and all the equipment necessary for the correct functioning of said basin, swimming pool, etc.; lining the internal walls of the receptacle with stones laid on top of said waterproofing layer; and applying a special binding resin on said lining stones before laying or immediately after laying the stones. In one embodiment, a particular support surface for the stones may be formed, composed of a series of flat modular elements, preferably flexible, provided with ribbing, grooves, pegs or ridges for containing and supporting said lining stones.

BRIEF DESCRIPTION OF THE DRAWINGS

The characteristics of the new process for the construction of basins, swimming pools, fountains and artificial ponds in general will be better clarified by the following description with reference to the drawings, enclosed as a non-limiting example.

DETAILED DESCRIPTION OF EMBODIMENTS OF THE INVENTION

The excavation (T) is carried out according to the known techniques, with the methods required by constructive necessities.

Said excavation (T) may have any shape and depth, as dictated by the client.

To make even the bottom (T1) of the excavation (T), a foundation layer (S) is prepared, by laying a layer of sand, clay or other suitable material to level the bottom of the excavation (T).

Said foundation layer (S) is covered with a sheet (TS) of non woven fabric, on which the waterproofing layer (I) is laid.

Said waterproofing layer (I) is constructed with sheets of polymer material such as PVC, or another waterproof material with similar characteristics.

Figure 3:
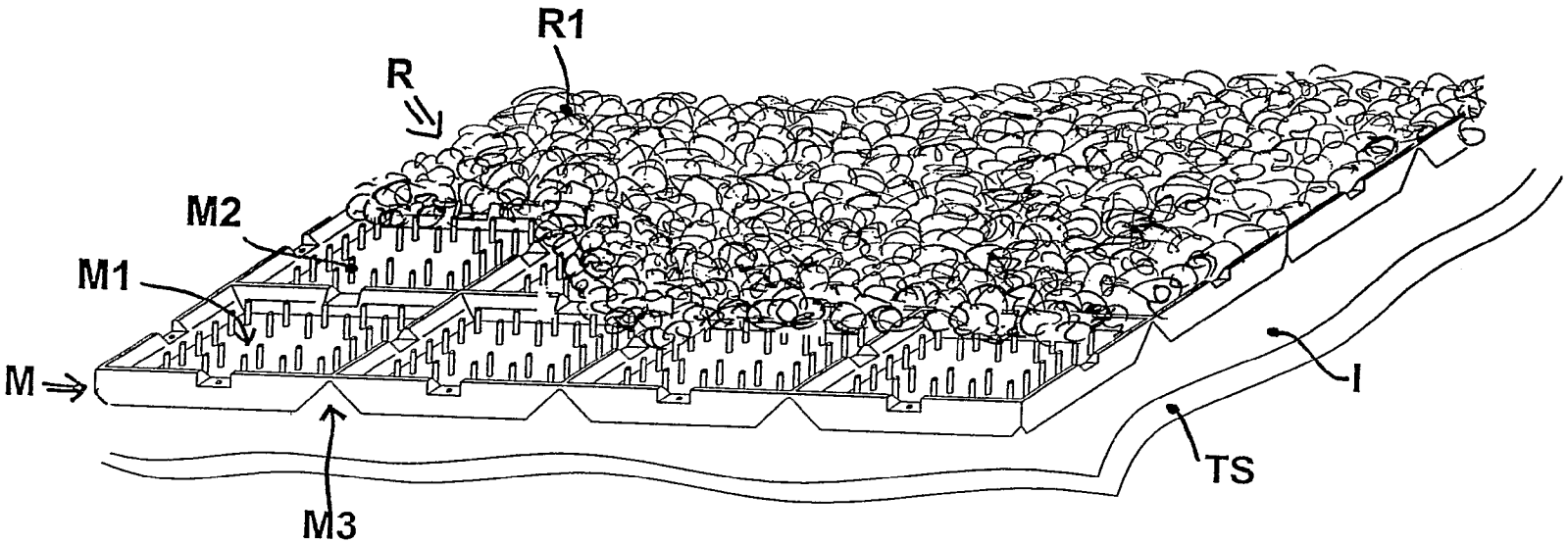
FIG. 3 shows in detail a part of the lining obtained by laying the stones (R1) of the lining (R) on modular elements (M).

As shown in FIG. 3, it is also preferable to contemplate the laying of a support surface for the stones (R1) of the lining (R).

Said surface is made up of a plurality of modular elements (M) made preferably of a deformable material, suited to follow the profile of the excavation (T), and where said modular elements (M) are positioned on top of said waterproofing layer (I).

Each of said modular elements (M) is preferably subdivided, by means of one or more folding lines (M3), into concave sections (M1) inside which are laid the stones (R1) of the lining (R).

To guarantee a more stable positioning of the stones (R1), said modular elements (M) comprise a plurality of protruding elements or pegs (M2) to block the stones (R1) in place.

The final phases consist of the operations of lining the walls of the receptacle and applying the necessary special equipment for correct functioning, such as inlets and outlets, filters, etc.

For the construction of the lining (R) of the internal walls and of the bottom of the receptacle, the new process contemplates the use of natural materials, such as river stones (R1), pebbles and rocks of various sizes and shapes, preferably rounded and smoothed, that is, without sharp corners.

The process contemplates the positioning of said stones (R1) inside the receptacle, on top of said waterproofing layer (I), or said elements (M), to cover the entire surface of the receptacle.

Said lining layer (R) is made stable by applying a special binding resin (C), suited to bind the stones (R1) in the desired position. This treatment of covering the stones may be carried out after laying the stones or pebbles or before laying them by mixing pebbles and/or stones of a suitable size in a mixer with resin, still in a fluid state.

Figure 1:
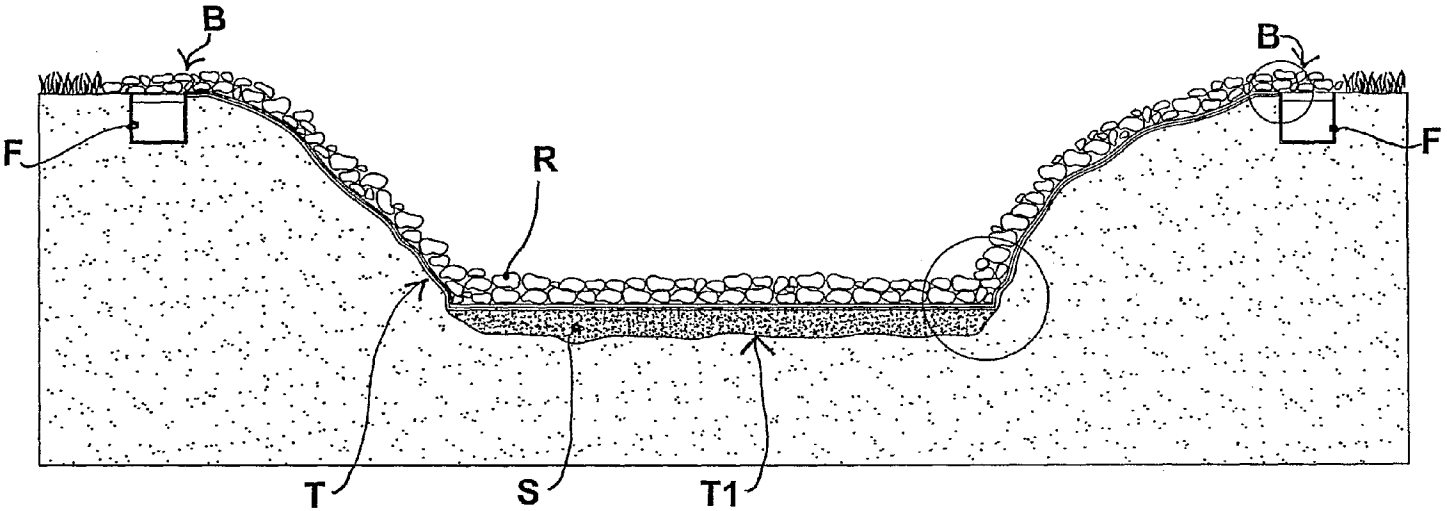
FIG. 1 shows a section of the receptacle, represented in a simplified way, without illustrating details related to the drainage equipment, the filters, the pumps, etc.
Figure 2B:
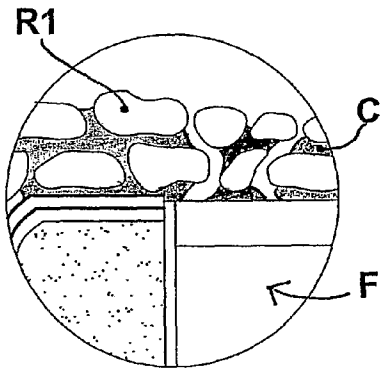
FIG. 2*b* shows a detail of the overflow and of the perimeter channel (F) covered by the stones (R1) of the lining (R).
Figure 2A:
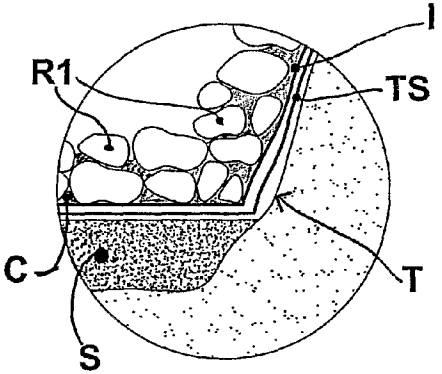
FIG. 2*a* shows an alternative solution for laying the binding resin (C).
Figure 2:
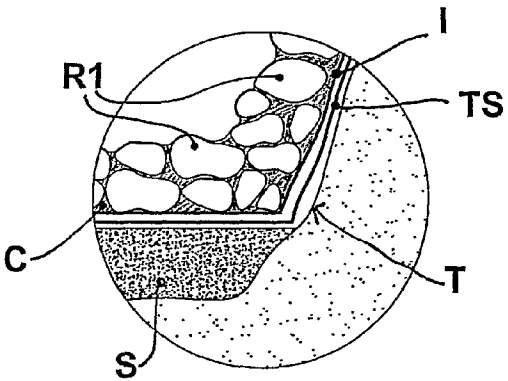
FIG. 2 shows a detail of FIG. 1, where the sequence of layers that make up the manufactured item can be seen.

Said binding resin (C) may be homogeneously distributed on the whole lining, to cover all the stones (R1) completely, as shown in FIG. 2.

Alternatively, said binding resin (C) may be distributed as shown in FIG. 2*a*, that is, filling the interstitial spaces in the lining layer (R), but leaving the free surface of the stones (R1) uncovered.

Said smoothed natural stones (R1) may also be used to cover the edge (B) of the receptacle, where the overflows are usually located, as well as the perimeter channels (F) and the equipment for collecting, filtering and recirculating the water.

Said natural stones (R1) may be laid distributing the binding resin (C) in such a way as not to saturate the interstitial spaces between the stones (R1), thus creating a waterproof draining layer through which the water leaves the receptacle and is collected beyond the overflows, in the perimeter channels (F). (FIG. 2*b*)

Therefore, with reference to the above description and to the enclosed drawings, the following claims are put forth.

What is claimed is:

1. A process of constructing, a water receptacle comprising:

laying of one or more sheets of a fabric on an internal surface of an excavation and/or on a foundation layer disposed over the internal surface;

laying a waterproofing layer on top of said sheet of fabric;

disposing filters, ducts, inlets and outlets, collecting channels as required for the correct functioning of said receptacle; and lining the internal walls of the receptacle and/or of the bottom of the receptacle with stones laid on top of said waterproofing layer, wherein said stones are wholly or partly covered with a binding resin;

further comprising the step of interposing a support surface comprising a plurality of modular elements between the waterproofing layer and the stones, the modular elements having retaining members holding the stones in position.

2. The process according to claim 1, wherein the stones mixed with said binding resin before lining the internal walls.

3. The process according to claim 1, wherein the binding resin is distributed homogeneously at least in part of interstitial spaces between the stones.

4. The process according to claim 1, wherein the binding resin is distributed homogeneously both in interstitial spaces between the stones and on the surface of said stones, thereby covering and waterproofing the stones.

5. The process of claim 1, wherein the stones are also laid above overflows and perimeter channels of the receptacle, providing a draining layer where the binding resin is distributed in such a way as to not completely saturate interstitial spaces between the stones.

6. The process according to claim 1, wherein the stones are smoothed natural stones.

7. The process according to claim 1, wherein the stones are artificial.

8. The process according to claim 1, further comprising an application of a profile, positioned below said waterproofing layer and below the stones, thereby adding a complex shape to the receptacle.

9. The process according to claim 8, wherein the profile comprises polystyrene.

10. The process according to claim 1, wherein the retaining members comprise ridges, pegs, or folds.

* * * * *